US011851900B2

(12) United States Patent
Brim, III et al.

(10) Patent No.: US 11,851,900 B2
(45) Date of Patent: Dec. 26, 2023

(54) TEMPORARY SAFETY RAILING SYSTEM AND METHOD

(71) Applicant: CHOATE CONSTRUCTION COMPANY, Atlanta, GA (US)

(72) Inventors: James Croswell Brim, III, Marietta, GA (US); Robert Paul Hanes, Jr., Moreland, GA (US); Hunter Moore, Sandy Springs, GA (US); Brian Keaton, Covington, GA (US); David A. Nance, Powder Springs, GA (US)

(73) Assignees: James Croswell Brim, III, Marietta, GA (US); Robert Paul Hanes, Jr., Moreland, GA (US)

( * ) Notice: Subject to any disclaimer, the term of this patent is extended or adjusted under 35 U.S.C. 154(b) by 474 days.

(21) Appl. No.: 16/776,652

(22) Filed: Jan. 30, 2020

(65) Prior Publication Data

US 2021/0238872 A1 Aug. 5, 2021

(51) Int. Cl.
*E04G 23/00* (2006.01)
*E04G 21/32* (2006.01)
(Continued)

(52) U.S. Cl.
CPC ..... *E04G 21/3223* (2013.01); *E04H 17/22* (2013.01); *E04H 17/146* (2021.01); *E04H 17/1465* (2021.01)

(58) Field of Classification Search
CPC ..... E04H 17/21; E04H 17/22; E04H 17/146; Y10T 403/32491; Y10T 403/32508; E04G 21/3223
(Continued)

(56) References Cited

U.S. PATENT DOCUMENTS 3,480,257 A * 11/1969 Bourn ..... E04G 5/045 182/113
3,920,221 A * 11/1975 Berry ..... E04G 21/3233 52/707
(Continued)

FOREIGN PATENT DOCUMENTS

CA 2278086 A1 * 1/2001 ..... E04G 21/3219

OTHER PUBLICATIONS

Guardian Fall Protection, "Product Name: C-Slab Grabber", Instructions Manual, pp. 1-8, published before Jan. 30, 2020.
(Continued)

*Primary Examiner* — Joshua T Kennedy
(74) *Attorney, Agent, or Firm* — GARDNER GROFF & GREENWALD, PC

(57) ABSTRACT

A temporary upright post includes rail supports for holding temporary lateral guardrails and a mounting system for mounting to a permanent upright stanchion of a permanent railing system for an elevated surface. The mounting system includes a longitudinal bore in the lower portion of the upright post that removably receives the stanchion with a loose fit, and the mechanical securement tightens the post to the stanchion to secure them together for use and loosens to release the post for installation and removal. Example embodiments also include a support bearing that is repositionable to contact and support the post in an elevated position on the stanchion, up and away from the elevated surface, or to disengage from mechanical interference with the stanchion so the post can be lowered to the use position.

20 Claims, 5 Drawing Sheets

(51) Int. Cl.
*E04H 17/22* (2006.01)
*E04H 17/14* (2006.01)

(58) Field of Classification Search
USPC ..... 256/65.04, 65.05, 65.14
See application file for complete search history.

(56) References Cited

U.S. PATENT DOCUMENTS 4,979,725 A * 12/1990 Hutchings, II ..... E04G 5/06 256/60
5,913,508 A * 6/1999 Eades ..... E04G 21/3204 211/208
6,038,829 A * 3/2000 Franks ..... E04G 21/3242 52/645
6,039,150 A * 3/2000 Palmer ..... E04G 21/3223 182/113
6,540,196 B1 * 4/2003 Ellsworth ..... E01F 9/635 248/548
2003/0132427 A1 * 7/2003 Allenbaugh ..... E04G 21/3233 256/65.14
2007/0246299 A1 * 10/2007 Wright ..... E04G 21/3242 182/113
2009/0127534 A1 * 5/2009 Powell ..... E04G 21/3233 256/65.02
2010/0012811 A1 * 1/2010 MacKenzie ..... F16B 7/182 248/157
2011/0272659 A1 * 11/2011 Gutierrez ..... E04G 21/3204 256/68
2012/0080655 A1 * 4/2012 Coffin ..... E04G 21/3204 29/525.01
2018/0127993 A1 * 5/2018 Baca ..... E04G 21/3233
2020/0270882 A1 * 8/2020 Buenemann ..... E04G 5/14

OTHER PUBLICATIONS

Guardian Fall Protection, "Product Name: C-Slab Grabber", Product Info, p. 1, published before Jan. 30, 2020.

* cited by examiner

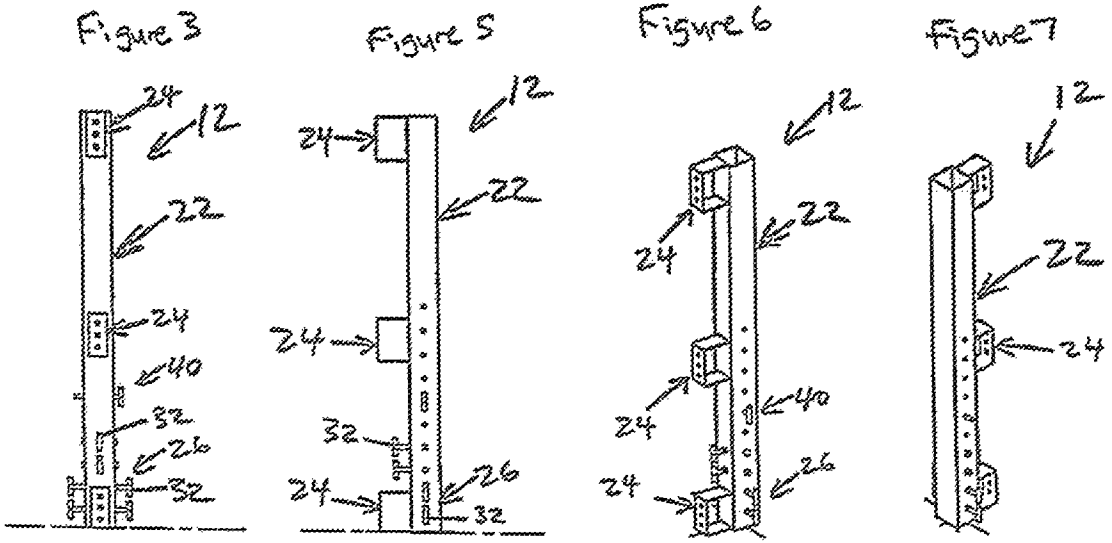
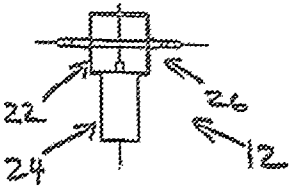
Figure 4

TEMPORARY SAFETY RAILING SYSTEM AND METHOD

TECHNICAL FIELD

The present invention relates generally to fall protection during building construction, and particularly to temporary safety guardrails for worker safety in elevated work locations of construction sites.

BACKGROUND

During the construction of multistory buildings or other tall/elevated structures and facilities, workers sometimes need to perform work tasks in elevated locations before permanent safety railing has been installed. For example, on multifamily building projects such as apartments, senior living facilities, and hotels, the balconies are a safety problem because of the risk of workers falling before the permanent railing is installed. The balconies are also problematic from a construction sequencing standpoint because of the need to install the permanent railing sooner (for worker safety) than is sometimes preferred (e.g., to avoid damage to the permanent railing while major construction is still ongoing). This is a problem for not just exterior balconies but also for interior balconies (e.g., adjacent stairwells) as well as exterior and interior stairwells, bridges, elevated walkways, roof-top spaces (e.g., pool decks, gardens, and gathering places), and other elevated locations that extend close to the edge of the building or other structure.

To address these problems, temporary guardrails are sometimes installed. This typically includes field-cutting wooden posts (e.g., 2×4 lumber) to length for use as posts, nailing the posts in place along the edge of the balcony, and nailing wooden rails (e.g., 2×4 lumber) to the posts. But these custom-built temporary railing solutions have not proven entirely satisfactory. In many cases, the temporary railing needs to be removed (e.g., to provide exposure/clearance for waterproofing the decking or other working surface it's mounted to and/or adjacent to) and replaced during the construction process, and this type of field-rigged temporary railing is time-consuming to build, remove, and replace. In addition, this type of temporary railing can loosen from random impacts during the ongoing construction process and thereby lose its structural integrity, leading to an increased risk of failure and worker falls.

Accordingly, it can be seen that a need exists for improvements in fall protection for construction projects. It is to the provision of solutions meeting this and other needs that the present invention is primarily directed.

SUMMARY

Generally described, the present invention provides a temporary safety railing system and method for preventing falls from elevated surfaces such as balcony decks. A temporary upright post includes rail supports for holding temporary lateral guardrails and a mounting system for mounting to a permanent upright stanchion of a permanent railing system for an elevated surface. The mounting system includes a longitudinal bore in the lower portion of the upright post that removably receives the stanchion with a loose fit, and the mechanical securement tightens the post to the stanchion to secure them together for use and loosens to release the post for installation and removal. Example embodiments also include a support bearing that is repositionable to contact and support the post in an elevated position on the stanchion, up and away from the elevated surface, or to disengage from mechanical interference with the stanchion so the post can be lowered to the use position.

Example methods of use provide for positioning the posts on the stanchions with the longitudinal bores receiving the stanchions and securing them there by tightening the mechanical securements. Then later the methods can include loosening the mechanical securements, lifting the posts, and installing the support bearings to support the posts in an elevated position on the stanchions to provide clearance for performing intermediate construction steps. Also, the methods can include later returning the posts to their lowered use positions and/or removing the posts just before installing the permanent railing system on the stanchions.

The specific techniques and structures employed by the invention to improve over the drawbacks of the prior devices and accomplish the advantages described herein will become apparent from the following detailed description of example embodiments and the appended drawings and claims.

BRIEF DESCRIPTION OF THE DRAWINGS

FIG. 3 shows one of the upright posts of FIG. 1.

FIG. 4 is a plan view of the upright post of FIG. 3.

FIG. 5 is a right side view of the upright post of FIG. 3.

FIG. 6 is a front perspective view of the upright post of FIG. 3.

FIG. 7 is a rear perspective view of the upright post of FIG. 3.

DETAILED DESCRIPTION OF EXAMPLE EMBODIMENTS

Figure 1:
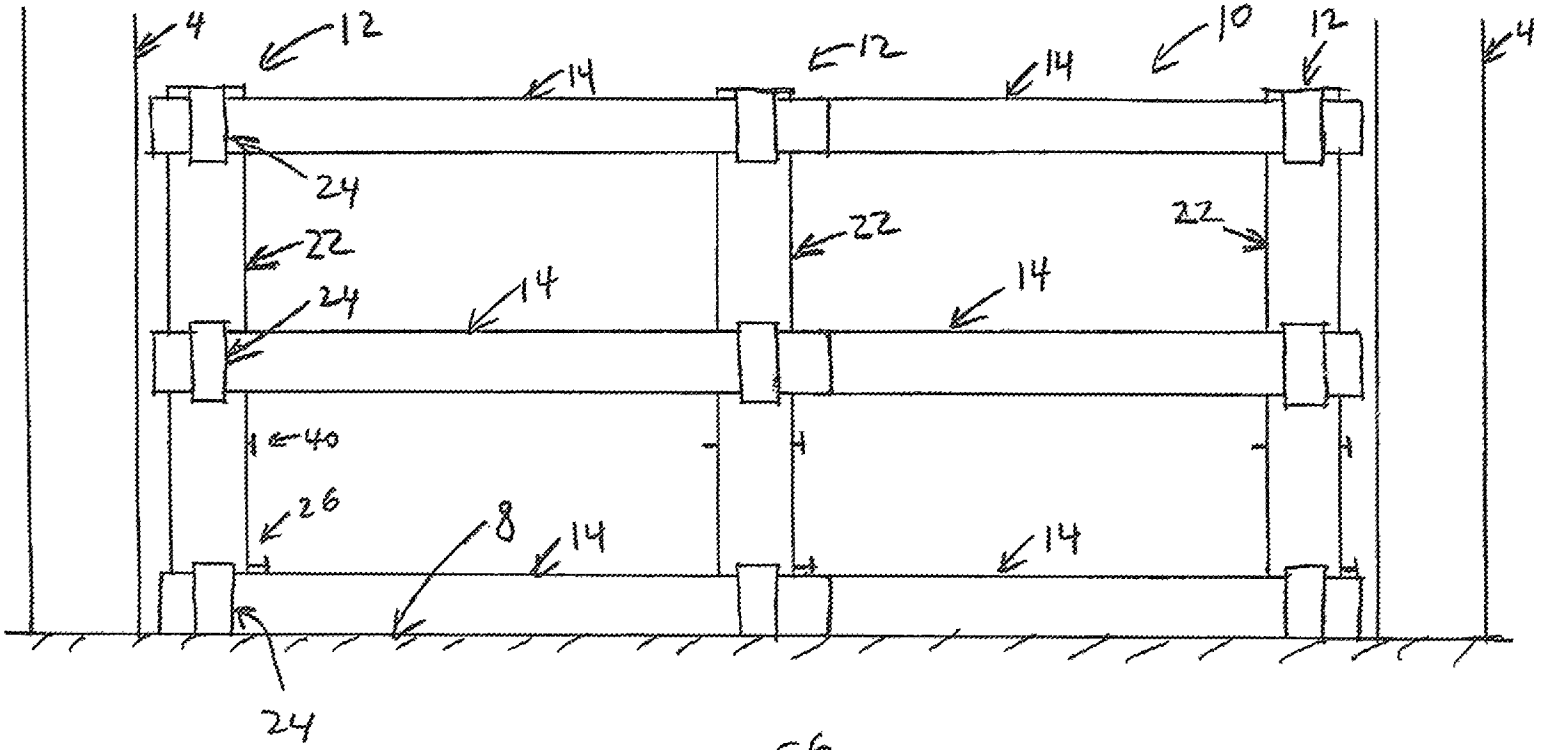
FIG. 1 is a front elevation view of a temporary safety railing system according to an example embodiment of the present invention, showing three temporary upright posts holding temporary lateral guardrails in place on a balcony.

Referring now to the drawing figures, FIGS. 1-10 show a temporary safety railing system 10 according to an example embodiment of the present invention. The temporary safety railing system 10 provides a safe, reliable, temporary, and reusable fall-prevention safety barrier for use on construction projects where railing-post bases (e.g., provided in post base kits) are used for permanent rails. Also, the temporary safety railing system 10 can be installed earlier in the construction process (relative to conventional temporary safety railing) and remain in place until the permanent railing is ready to be installed, thus eliminating the replacement problem with conventional temporary safety railing. In addition, the temporary safety railing system 10 of example embodiments meets the applicable OSHA standard to ensure proper safety and reliability.

The temporary safety railing system 10 includes a plurality of upright posts 12 that support at least one lateral guard element 14 to provide a safety barrier for fall protection. In the depicted embodiment, the upright posts 10 each support three lateral guardrails 14, which can be conventional 2×4 lumber/boards. In other embodiments, the upright posts are adapted to support more (i.e., four or more) or fewer (i.e., one or two) lateral guard elements, which can be for example 2×6 lumber/boards, a sheet of plywood, other wood boards, chains, cables, fencing, screening, or other lateral guard elements to provide a safety barrier for fall protection.

The upright posts 12 securely mount onto permanent upright stanchions 16 to which the permanent posts of the permanent safety railing system will be later mounted for permanent use. As such, the upright stanchions 16 are conventionally provided in post base kits for mounting permanent railings in applications such as balconies of residential and commercial multistory buildings. Conventional upright stanchions 16 of this type are made of a strong and durable metal (e.g., carbon steel) and include an upright post extending upward from a lateral mounting base plate that in turn mounts to the working surface (e.g., floor or decking). Conventional post base kits of this type include the upright stanchions 16 and additionally include for example mounting hardware (e.g., bolts and washers) for mounting the base plate to the working surface. For example, permanent safety railing systems including such post base kits with such upright stanchions 16 are commercially available from Nexan Building Products, Inc. under the brand RAILINGWORKS. These elements are conventional and well-known to persons of ordinary skill in the industry, so additional details are not provided for the sake of brevity. In other embodiments, the upright posts are adapted to mount to other types of stanchions for the same or other applications in elevated locations of tall/elevated buildings/structures, as is understood by persons of ordinary skill in the art.

In some embodiments, the temporary safety railing system 10 includes the upright posts 12, the lateral guardrails 14, and the upright stanchions 16 (or the base post kits) provided together. In other embodiments, the temporary safety railing system 10 includes only one of two of these components, with the others provided separately. For example, the temporary safety railing system 10 can include only the upright posts 12, with the lateral guardrails 14 provided by locally available lumber and the upright stanchions 16 (or base post kits) provided with the permanent railing system.

The permanent upright stanchions 16 are typically mounted to an elevated floor, decking, or other working surface 8 in a location that is adjacent to an edge 6 of the elevated working surface 8, because that is where the permanent railing is typically installed. Because the temporary safety railing system 10 is installed onto the permanent stanchions 16, the temporary safety railing system 10 is typically also installed adjacent to the edge 6 of the elevated working surface 8.

Turning now to the details of the upright posts 12, they each include an upright structural element 22 with at least one rail support 24 for supporting at least one of the lateral guardrails 14 and with a mounting assembly 26 for mounting to a respective permanent upright stanchion 16. These components of the upright posts 12 can be made of a strong and durable metal (e.g., carbon steel) using conventional manufacturing techniques and equipment.

In the depicted embodiment, there are three rail supports 24, one at the bottom of the upright structural element 22, one at the top of the upright structural element 22, and one at an intermediate position/height of the upright structural element 22, with each removably securing in place a respective one of the three lateral guardrails 14. The top and middle rail supports 24 hold the top and middle lateral guardrails 14, which form a barrier that will brace the fall of a worker on the elevated surface 8. And the bottom rail support 24 holds the bottom lateral guardrail 14, which forms a barrier that prevents construction tools, materials, and debris from being knocked across the elevated surface 8 and over the edge 6 and then falling onto workers below the elevated surface 8. In other embodiments, the upright posts can each include more or fewer rail supports at other positions on the upright structural element for holding the lateral guard elements at different positions/heights, as may be desired for a given application.

Figure 2:
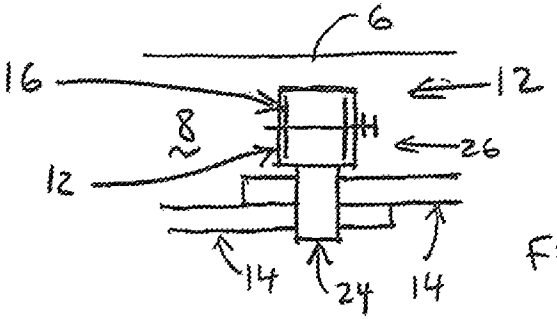
FIG. 2 is a plan view of the center upright post and portions of the lateral guardrails of FIG. 1.

The rail supports 24 can be loops extending from the upright structural element 22, as in the depicted embodiment. For example, each rail support loop 24 can be formed by a U-shaped or C-shaped member with its open side attached (e.g., welded) to an upright structural element 22 (i.e., to form a closed loop), typically attached to the front side of the upright structural element 22 and thus extending inwardly (i.e., away from the elevated surface edge 6) over the elevated surface 8, as shown in FIGS. 1-7. Also, the rail support loops 24 can have an internal hollow bore that's substantially rectangular and sized (e.g., with a height and depth) to removably receive and support laterally overlapping end portions of two 2×4 lateral guardrails, as shown in FIGS. 1-2. In a typical commercial embodiment, for example, the rail support loops 24 have an internal bore of about 4.0 inches to about 4.5 inches high by about 3.0 inches to about 3.5 inches deep (front-to-back, over the elevated surface 8). Thus, the lateral guardrails 14 can easily be longitudinally slid into the rail support loops 24 where they are supported during use to form a protective barrier against workers falling off the elevated surface 8, and then they can easily be longitudinally slid back out of the rail support loops 24 and removed from the site after use.

In other embodiments, the rail supports can be loops having a different shape, size, and/or location, for example top-mounted loops (e.g., extending upward from the top of the upright structural elements, for the top rail supports). In yet other embodiments, the rail supports can be hooks, clamps, through-holes (e.g., extending laterally through the upright structural elements, for the top and middle rail supports), lateral-side-mounted receptacles (e.g., two receptacles extending laterally from the opposite lateral sides of the upright structural elements, each for receiving an end portion of a respective one of the lateral guardrails, with the two guardrails thus not laterally overlapping). In still other embodiments, the rail supports can be pivots that fixedly and pivotally mount non-removable lateral guard elements to the upright structural elements so the lateral guard elements swing from a down storage position (in-line with the respective upright structural element) upward to a lateral use position (in-line with at least one adjacent lateral guard element) where adjacent ones of the lateral guard elements have end portions that releasably connect together for use. And in yet still other embodiments, the rail supports can be provided by other conventional structures that support the lateral guard elements for their intended purpose as described herein.

The mounting assembly 26 of the upright posts 12 is used to removably secure the upright structural element 22 to a respective one of the permanent upright stanchions 16. The mounting assembly 26 includes a bore 28 formed longitudinally through and into a lower portion of the upright structural element 22 and a mechanical securement 30 that releasably secures the upright structural element 22 to the upright stanchion 16. These components of the mounting assembly 26 cooperate to enable the upright post 12 to withstand a lateral force (i.e., in a direction over the balcony edge 6) of at least the minimum set by local code (e.g., 250 lbs.)

Figure 8:
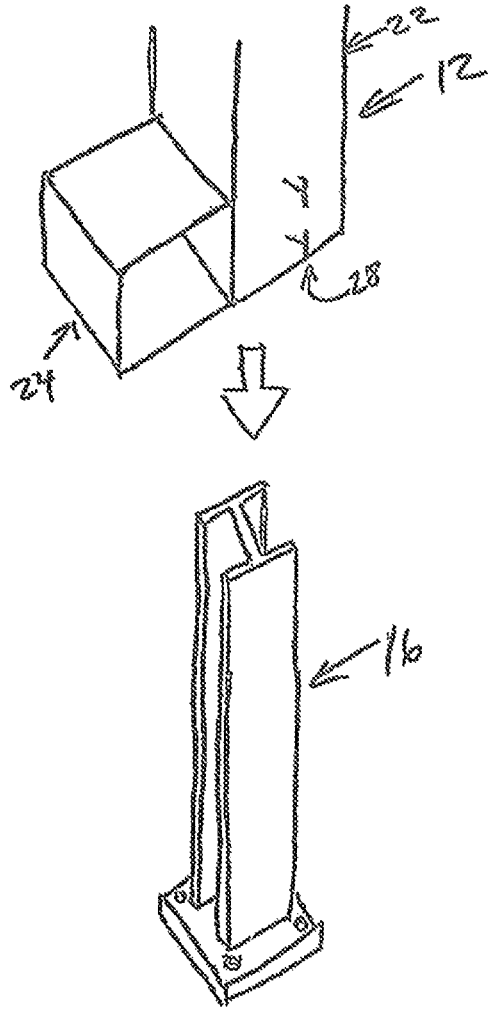
FIG. 8 is a perspective view of a lower portion of the left-side upright post of FIG. 1 being installed on a prior-art permanent stanchion of a permanent railing system.
Figure 9:
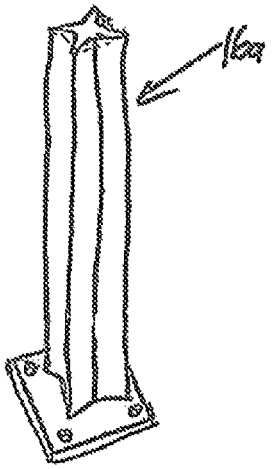
Figure 9 (Prior Art)
FIG. 9 is a perspective view of an alternative prior-art permanent stanchion onto which the upright post of FIG. 1 can be installed.

The longitudinal bore 28 is sized and shaped to removably receive a respective one of the permanent upright stanchions 16 in a mounting position, with a telescopic arrangement, with overlapping longitudinal portions, and with a slightly loose fit, so that the upright structural element 22 can easily be slid down onto the permanent upright stanchion 16 and secured there (i.e., by the mechanical securement 30) for use and then when the permanent railing system is to be installed the upright structural element 22 can be easily pulled back up and removed. Conventional upright stanchions 16 are typically about 2.5 inches by about 2.5 inches in their largest cross-sectional dimensions, and about 1.0 feet to about 2.5 feet high. For example, one such conventional upright stanchion 16 is shown in FIG. 8 (see also FIG. 9 for another type of conventional upright stanchion 16*a* that the upright post 12 can be mounted to and used with). Accordingly, in a typical commercial embodiment, the longitudinal bore 28 is about 3.0 inches by about 3.0 inches in its cross-sectional dimensions, and at least about 2.5 feet high (i.e., the longitudinal dimension into the upright structural element 22). Of course, other types and sizes of conventional stanchions exist, and persons of ordinary skill in the art will understand how to readily adapt the size and shape of the upright structural element 22 and its longitudinal bore 28 to provide the mounting functionality described herein.

Figure 10:
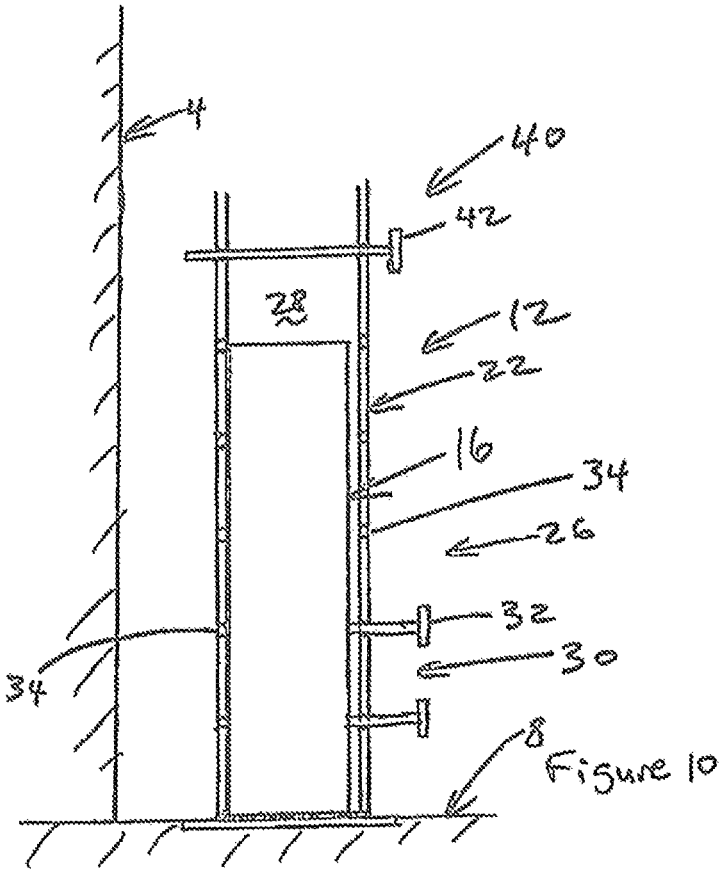
FIG. 10 is a front cross-sectional elevation view of the upright post and stanchion of FIG. 8 in an installed use position on the balcony.

This provides the "slightly loose" fit, meaning that the fit is loose enough that the upright structural element 22 can be slid down onto the permanent upright stanchion 16 with perfectly true alignment not required to avoid mechanical interference, such that the upright structural element 22 can be placed above the permanent upright stanchion 16 in only approximate alignment and the longitudinal bore 28 slid down onto the upright stanchion 16 without significant frictional resistance, as shown in FIG. 8. But the fit is close enough (i.e., the gap is sufficiently small), and the overlapping length of the telescopically arranged portions (of the upright structural element 22 and the permanent upright stanchion 16) is sufficiently long, that in the mounted position there is only negligible "play" between the upright structural element 22 and the permanent upright stanchion 16 so the upright structural element 22 can only wiggle slightly side-to-side and so that the mechanical securement 30 can then be used to tighten down the components to eliminate even that movement, as shown in FIG. 10.

In some embodiments, the upright structural element 22 is a piece of tube with the longitudinal bore 28 extending all the way through its all its entire length. For example, the depicted upright structural element 22 is a rectangular cross-section tube made of steel and having a length (height) of about 3.5 feet. In such embodiments, the height of the longitudinal bore 28 is effectively the length of the hollow tubular member, which is typically about 3.5 to about 4.0 feet. In other embodiments, the upright structural element is not hollow along its entire length, for example, it can include an upper portion (e.g., solid, tubular but with a filler, etc.) attached to a tubular bore-defining lower portion (e.g., of the same or a different cross-sectional shape and size as the upper portion). In other embodiments, the upright structural element can be provided by other longitudinal structural members, for example two longitudinal structural members that are field-clamped together onto the stanchion by a mechanical securement in order to hold them tightly and securely to the stanchion.

The mechanical securement 30 is repositionable between a securing position contacting and tightly holding the upright structural element 22 to the upright stanchion 16 for use for fall prevention and a disengaged position free from contact with the upright stanchion 16 so the structural element 22 can be slid on and off the stanchion 16 for installation and removal. The mechanical securement 30 can include conventional fasteners known in the art. For example, the mechanical securement 30 can include linearly moveable fasteners that can be linearly extended from the disengaged position to the securing position and then linearly retracted back to the disengaged position. Such linearly moveable fasteners can include bolts, threaded pins, spring-biased pins, unthreaded pins (extendable into aligned openings in the stanchions), clamps, and other mechanical fasteners with linearly translating/reciprocating elements that are operable to provide the securing functionality described herein. Other suitable mechanical securements can include shims or spacers that insert through larger unthreaded openings in the upright structural element, straps (e.g., cables) that extend through multiple openings in the upright structural element, or other mechanical fasteners to provide the securing functionality described herein.

For example, the depicted mechanical securement 30 includes at least one threaded bolt 32 that extends through at least one threaded opening 34 in the upright structural element 22. The threaded bolt 32 can be provided by a T-bolt (with outer screw threading) and the threaded opening 34 can be provided by a nut (with mating inner screw threading) with its hole aligned with a hole in the upright structural element 22 and with the nut mounted (e.g., welded) to the structural element 22. Other embodiments include other types of threaded bolts and threaded openings in other quantities (e.g., multiple bolts and openings at multiple locations for more contact points and thus enhanced securement).

In example embodiments, at least one vertical series of the threaded openings 34 are formed in the upright structural element 22 so that one or more of the threaded bolts 32 can be extended through one or more respective openings 34 selected for best engagement with the particular stanchion 16 being mounted to. In the depicted embodiment, for example, two threaded T-bolts 32 are screwed into the two lowest right-lateral side threaded openings 34 of a series of threaded openings 34, as shown in FIG. 10.

Also, to provide for good contacting and holding forces, and for good flexibility of use, multiple vertical series of the threaded openings 34 can be formed on multiple different sides of the upright structural element 22. For example, the front side and at least one of the adjacent lateral sides can include a respective vertical series of the threaded openings 34, so that threaded bolts 32 can be installed perpendicularly to each other to provide securing contact with two adjacent sides of the stanchion 16 (with the other two sides of the stanchion in securing contact with the respective walls of the upright structural element 22) to eliminate play in all generally horizontal directions to provide greater securement, as shown in FIGS. 3-7. The threaded openings 34 on the front side of the upright structural element 22 can be positioned above the rail supports 24, as shown.

Furthermore, both opposite lateral sides of the upright structural element 22 can include a respective vertical series of the threaded openings 34, so that the installer can select which lateral side to insert the threaded bolts 32. This is particularly helpful for uprights posts 12 mounted to stanchions 16 at the end of a railing system, as these are typically positioned very close (e.g., 4 inches maximum, or as set by local code) to permanent building-support columns 4, and this arrangement enables the installer to select the lateral side away from the column 4 where there is clearance to install the threaded bolts 32, as shown in FIGS. 1 and 10.

In addition, the upright posts 12 can each additionally include a raised-position support assembly 40 having at least one support bearing 42 that is repositionable between a supporting position and a disengaged position. In the supporting position, the repositionable support bearing 42 contacts, and supports the upright structural element 22 in an elevated position on, the upright stanchion 16. And in the disengaged position, the repositionable support bearing 42 is free from contact with the upright stanchion 16 so that the structural element 22 can be slid all the way down onto the stanchion 16 to the use position. This is helpful for example in situations when the temporary uprights posts 12 would otherwise interfere with construction steps and conventional temporary railing would have to be removed and later replaced. In some embodiments, the mechanical securement 30 dual-functions to also provide this supporting function and thus a separate raised-support assembly is not included.

The repositionable support bearings 42 can be fasteners of the same type as the fasteners 32 included in the mechanical securement 30. Thus, the raised-support assembly 40 can include threaded bolts 42 that extend through cooperating threaded openings 34 in the upright structural element 22. The threaded openings 34 of the support assembly 40 can be included in the series of threaded openings 34 used for the mechanical securement 30 of the upright structural element to the upright stanchion 16, as depicted, in which case all the threaded openings 34 have the same size and threading for maximum flexibility of use, and the support bearings 42 and the fasteners 32 have the same diameter and threading. In other embodiments, separate threaded openings, having the same or a different diameter and threading, can be provided in the raised-support assembly.

Figure 11:
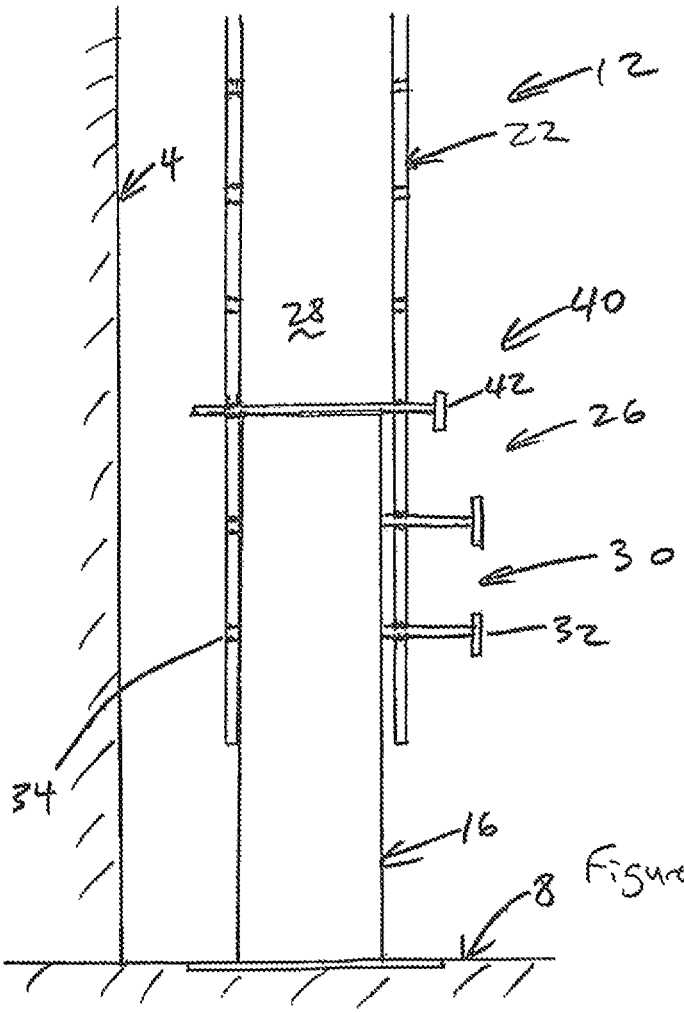
FIG. 11 shows the upright post and stanchion of FIG. 10 with the upright post supported in an installed raised position relative to the stanchion.

In a typical commercial embodiment, both opposite lateral sides of the upright structural element 22 include respective vertical series of the threaded openings 34, and the support bearing 42 has a length selected so that in the supporting position it extends all the way through the upright structural element 22 (and thus through two aligned ones of the threaded openings 34 and all the way across the longitudinal bore 28) and is supported atop the upright stanchion 16 to suspend the upright structural element 22 in the elevated position, as shown in FIG. 11. The user can select which two aligned threaded openings 34 to use based the height of the upright stanchion 16 and based on how much height clearance is needed for the upright posts 12 above the working surface 8.

In other embodiments, the raised-support assembly includes another type of support bearing. As noted, the support bearing can be a linearly moveable fastener 32 of any type described herein or alternatively a bar, rod, or arm without threading but with a retainer (e.g., a clip or pin). In other embodiments, the support bearing can be a pivotal retainer (e.g., a bracket or arm) or another structural support element for providing the supporting functionality described herein.

In a method of temporarily protecting against falls from elevated surfaces, the upright stanchions 16 are installed on the decking or other elevated surface 8, with the stanchions 16 typically being installed during or as a final step in the process of building the elevated surface 8. Before proceeding with any further construction step, a temporary safety railing system 10 is next installed. The temporary safety railing system 10 can be of any type described herein or another type. The temporary upright posts 12 are next positioned on the upright stanchions 16, with the longitudinal bore 28 of the upright posts 12 slid down over and onto the stanchions 16, and secured in place there by tightening the mechanical securements 30. The lateral guardrails 14 are then installed into a position supported by the rail supports 24 to complete the temporary safety railing system 10.

At some later time, an intermediate construction step may be needed in which the temporary upright posts 12 are in the way. For example, the decking or other elevated surface 8 may need to be waterproofed. When this is done, the base mounting plates of the upright stanchions 16, and the mounting hardware/connections to the elevated surface 8, will also need to be waterproofed. So the mechanical securements 30 are then loosened, the upright posts 12 (and thus also the lateral guardrails 14) are raised to an elevated position, and the bearing supports 42 are installed in a position selected to support the upright posts 12 in the elevated position on the upright stanchions 16. If desired, the mechanical securements 30 can be retightened to lock the upright posts 12 securely in place. After the waterproofing or other intermediate construction step is completed, the bearing supports 42 are disengaged, the uprights posts 12 (and thus also the lateral guardrails 14) are lowered and returned back to the use position, and the mechanical securements 30 are retightened to lock the upright posts 12 securely in place.

Later in the construction process, before the permanent railing is installed (typically, immediately prior to that), the temporary railing system 10 is removed. This includes removing the lateral guardrails 14 from the rail supports 24, loosening the mechanical securements 30, lifting the upright posts 12 off the upright stanchions 16, and removing the lateral guardrails 14 and the upright posts 12 from the elevated surface 8. Then the permanent railing system is installed as normal, with the permanent posts installed on the permanent stanchions 16.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in example forms, it will be apparent to those skilled in the art that many modifications, additions, and deletions can be made therein without departing from the spirit and scope of the invention as defined by the following claims.

What is claimed is:

1. A method of temporarily using a temporary safety post with a permanent stanchion of a permanent railing system to temporarily support one or more temporary lateral guardrails for fall-prevention of workers on an elevated surface, the temporary upright post method comprising:

providing the temporary upright post including:

an upright structural element;

one or more rail supports configured to hold the temporary lateral guardrails to the upright structural element;

a mounting system configured to mount the upright structural element to the permanent stanchion of the permanent railing system with the temporary safety post in a mounted/use position, wherein the mounting system includes a longitudinal bore in a lower portion of the temporary safety post that removably receives the permanent stanchion in a telescopic overlapping arrangement, wherein the mounting system includes at least one opening in the upright structural element and at least one linearly movable securement fastener that is linearly extendable through the opening and linearly repositionable between a securing position and a disengaged position, wherein the linearly movable securement fastener includes threads and the opening includes threads that mate with the fastener threads so that the securement fastener is linearly repositionable between the securing and disengaged positions, wherein in the securing position the securement fastener abuts the permanent stanchion to frictionally hold the upright structural element to the permanent stanchion, and wherein in the disengaged position the securement fastener is free from contact with the permanent stanchion so that the upright structural element can be removed from the permanent stanchion; and a raised-position support assembly including a support bearing that is repositionable between a supporting position supporting the temporary safety post in an elevated position on the permanent stanchion up and away from the elevated surface and a disengaged position free from contact with the permanent stanchion so that the temporary safety post can be lowered to the mounting/use position, temporarily mounting the temporary safety post to the permanent stanchion to support the temporary lateral quardrails for temporary worker fall safety during construction before the permanent railing system is installed, wherein the temporary safety post is temporarily mounted to the permanent stanchion by using the mounting system;

vertically repositioning the temporary safety post on the permanent stanchion by using the raised-position support assembly to elevate the upright structural element, then to position the support bearing in the supporting position, and then to release the upright structural element down to the elevated position, so that in the supporting position the support bearing supports the temporary safety post on the permanent stanchion in the elevated position up and away from the elevated surface for temporary worker fall safety during construct on without removing the temporary safety post from the permanent stanchion; and removing the temporary safety post from the permanent stanchion when ready to install the permanent railing system on the permanent stanchion to provide permanent worker fall safety.

2. The temporary safety post method of claim 1, wherein the upright structural element is tubular and the longitudinal bore of the mounting system extends end-to-end all the way through the tubular upright structural element.

3. The temporary safety post method of claim 1, wherein the mounting system further includes a mechanical securement that is repositionable between a securing position holding the upright structural element to the permanent stanchion in the mounting/use position and a disengaged position free from contact with the permanent stanchion so that the upright structural element can be removed from the permanent stanchion.

4. The temporary safety post method of claim 1, wherein the linearly movable securement fastener is a threaded bolt.

5. The temporary safety post method of claim 1, wherein the mounting system further includes a vertical series of openings in the temporary safety post, each configured to operably receive the securement fastener, wherein a user can select one of the openings to insert the securement fastener based on the permanent stanchion to be mounted and secured to.

6. The temporary safety post method of claim 1, wherein the mounting system further includes at least two of the securement fasteners and at least two of the openings in the temporary safety post, with the two openings formed in adjacent sides of the temporary safety post, and with the two securement fasteners receivable in the two openings of the adjacent sides so that the two mechanical securements are perpendicular in the securing position.

7. The temporary safety post method of claim 1, wherein the support bearing includes at least one linearly movable support fastener that is linearly repositionable between the supporting and disengaged positions.

8. The temporary safety post method of claim 7, wherein the linearly movable support fastener is a threaded bolt that extends side-to-side all the way across the upright structural element and wherein the raised-position support assembly further includes at least two aligned threaded openings in the upright structural element through which the threaded bolt extends in the supporting position, wherein vertically repositioning the temporary safety post on the permanent stanchion includes positioning the support bearing through the two aligned openings.

9. The temporary safety post method of claim 7, wherein the linearly movable support fastener of the raised-position support assembly is a threaded bolt, wherein the raised-position support assembly further includes at least one threaded opening in the upright structural element through which the raised-position threaded bolt extends in the supporting position, wherein the mounting system includes a threaded securement bolt and at least one threaded opening in the upright structural element through which the mounting-system threaded securement bolt extends in the mounting/use position, and wherein the raised-position threaded opening and the mounting-system threaded opening are included in a vertical series of threaded openings of the same size in the upright structural element.

10. The temporary safety post method of claim 1, wherein the rail supports are loops that extend from the upright structural element and receive end portions of the temporary lateral guardrails in an overlapping arrangement, and wherein a bottom one of the rail supports holds a bottom one of the temporary lateral guardrails, a top one of the rail supports holds a top one of the temporary lateral guardrails, and an intermediate one of the rail supports holds an intermediate one of the temporary lateral guardrails.

11. A temporary railing system including the temporary safety post, the temporary lateral guardrails, and the permanent stanchion of claim 1.

12. The temporary safety post method of claim 1, further comprising installing the permanent railing system on the permanent stanchion to provide permanent worker fall safety.

13. A method of temporarily using a temporary safety post for with a permanent stanchion of a permanent railing system to temporarily support to one or more temporary lateral guardrails for fall-prevention of workers on an elevated surface, the temporary upright post method comprising:

providing the temporary upright post including:

an upright structural element;

one or more rail supports configured to hold the temporary lateral guardrails to the upright structural element;

a mounting system configured to mount the upright structural element to the permanent stanchion of the permanent railing system with the temporary safety post in a mounted/use position, wherein the mounting system includes a longitudinal bore in a lower portion of the temporary safety post that removably receives the permanent stanchion with a slightly loose fit in a telescopic overlapping arrangement, and wherein the mounting system further includes a mechanical securement that is repositionable between a securing position holding the upright structural element to the permanent stanchion in the mounting/use position and a disengaged position free from contact with the permanent stanchion so that the upright structural element can be removed from the permanent stanchion; and a raised-position support assembly including at least two aligned openings in the upright structural element and a support bearing that is repositionable between a supporting position and a disengaged position, wherein the two aligned openings are positioned a distance from a bottom end of the upright structural element that is less than a height of the permanent stanchion so that in the supporting position the support bearing extends through the aligned openings in the upright structural element and across and atop the permanent stanchion to support the temporary safety post atop the permanent stanchion in an elevated position up and away from the elevated surface, and wherein in the disengaged position the support bearing is free from contact with the permanent stanchion so that the temporary safety post can be lowered to the mounting position, support the temporary lateral guardrails for temporary worker fall safety during construction before the permanent railing system is installed wherein the temporary safety post is temporary mounted to the permanent stanchion by using the mounting system;

vertically repositioning the temporary safety post on the permanent stanchion by using the raised-position support assembly to elevate the upright structural element, then to position the support bearing through the two aligned openings, and then to release the upright structural element down to the supporting position so that in the supporting position the support bearing extends through the aligned openings in the upright structural element and across and atop the permanent stanchion to support the temporary safety post atop the permanent stanchion in an elevated position up and away from the elevated surface for temporary worker safety during construction without removing the temporary safety post from the permanent stanchion; and removing the temporary safety post from the permanent stanchion when ready to install the permanent railing system on the permanent stanchion to provide permanent worker fall safety.

14. The temporary safety post method of claim 13, wherein the support bearing of the raised-position support assembly is a linearly movable support fastener that extends through the aligned openings in the upright structural element in the supporting position.

15. The temporary safety post method of claim 14, wherein the mounting system includes a linearly movable securement fastener and at least one opening in the upright structural element through which the mounting-system linearly movable securement fastener extends in the mounting position, and wherein the raised-position opening and the mounting-system opening are included in a vertical series of openings of the same size in the upright structural element.

16. The temporary safety post method of claim 15, wherein the linearly movable support fastener of the raised-position support assembly is a threaded bolt, wherein at least one of the two aligned openings of the raised-position support assembly is a threaded opening that mates with the threaded bolt and through which the raised-position threaded bolt extends in the supporting position.

17. A temporary railing system including the temporary safety post, the temporary lateral guardrails, and the permanent stanchion of claim 13.

18. The temporary safety post method of claim 13, further comprising installing the permanent railing system on the permanent stanchion to provide permanent worker fall safety.

19. A method of temporarily using a temporary safety post with a permanent stanchion of a permanent railing system to temporarily support one or more temporary lateral guardrails for fall-prevention of workers on an elevated surface, the temporary upright post method comprising:

providing the temporary upright post including:

an upright structural element including a lower portion with a longitudinal bore that removably receives the permanent stanchion in a telescopic overlapping arrangement;

one or more rail supports configured to hold the temporary lateral guardrails to the upright structural element;

a mounting system including at least one opening in the upright structural element and at least one linearly movable securement fastener that is linearly extendable through the opening and linearly repositionable between a securing position and a disengaged position, wherein in the securing position the securement fastener secures the upright structural element to the permanent stanchion in a mounted/use position, and wherein in the disengaged position the securement fastener is free from contact with the permanent stanchion so that the upright structural element can be removed from the permanent stanchion; and a raised-position support assembly including a support bearing that is repositionable between a supporting position supporting the temporary safety post in an elevated position on the permanent stanchion up and away from the elevated surface and a disengaged position free from contact with the permanent stanchion so that the temporary safety post can be lowered to the mounting/use position, temporarily mounting the temporary safety post to the permanent stanchion, by using the mounting system, to support the temporary lateral guardrails for temporary worker fall safety during construction before the permanent railing system is installed;

vertically repositioning the temporary safety post to the elevated position on the permanent stanchion by using the raised-position support assembly, including raising the upright structural element to above the elevated position, then positioning the support bearing in the supporting position, and then releasing the upright structural element down to the elevated position, so that in the supporting position the support bearing supports the temporary safety post on the permanent stanchion in the elevated position for temporary worker fall safety during construction without removing the temporary safety post from the permanent stanchion; and removing the temporary safety post from the permanent stanchion when ready to install the permanent railing system on the permanent stanchion to provide permanent worker fall safety.

20. A temporary railing system including the temporary safety post, the temporary lateral guardrails, and the permanent stanchion of claim 19.

* * * * *